United States Patent [19]

Belinsky

[11] 4,414,911

[45] Nov. 15, 1983

[54] BERTH FOR MOORING SUPPLY SHIP TO AN OFFSHORE PLATFORM AND FOR TRANSFERRING PERSONNEL BETWEEN THEM

[76] Inventor: Sidney I. Belinsky, 40 Waterside Plaza, Apt. 29M, New York, N.Y. 10010

[21] Appl. No.: 275,491

[22] Filed: Jun. 19, 1981

[51] Int. Cl.[3] ..... B63B 59/02

[52] U.S. Cl. ..... 114/219

[58] Field of Search ..... 114/219, 220, 230, 264, 114/265; 414/137–139

[56] References Cited

U.S. PATENT DOCUMENTS 3,426,542 2/1969 Hindman et al. ..... 114/219

4,003,473 1/1977 Ryan ..... 114/230

*Primary Examiner*—Trygve M. Blix

*Assistant Examiner*—Jesus D. Sotello

[57] ABSTRACT

The berth for offshore platform has a floating fendering system to which the supply boat is berthing and derrick crane which lifts the floating fendering system from water to the level of the upper deck of offshore platform. When berth is in working position the floating fendering system is connected to the suspended massive intermediate platform, which serves as a gravity absorption system, accomodating impact from the berthing ship and waves action. The boom of the derrick crane and suspension system for massive intermediate platform incorporates permanent ladders, which provide reliable and safe connection for personnel between the upper deck of the offshore platform and supply boat, moored to the platform. The passenger elevator is provided for more comfortable transportation for the personnel between the supply ship and upper deck of the platform.

7 Claims, 5 Drawing Figures

BERTH FOR MOORING SUPPLY SHIP TO AN OFFSHORE PLATFORM AND FOR TRANSFERRING PERSONNEL BETWEEN THEM

BACKGROUND OF THE INVENTION

This invention relates mainly to the offshore oil industry. Operation of a typical offshore drilling platform requires supply of many tons of various materials daily. These materials are delivered mainly by supply boats to the platform and lifted from the boat by platform's stationary crane. This operation requires relatively fixed position of the supply boat near the platform. Rough weather conditions during which many of the platform's re-supplies must be done, complicates this operation. Presently, in most of the cases, the supply boat is moored to the platform by two mooring lines, connected to their stern part and by bow anchor, which tensions the mooring lines, locating the supply boat on the same distance from the platform's structure and preventing it from free movement. This mooring system successfully protects the supply boat from collision with the platform's structure but practically excludes the use of any gangway for transporting perconnel, thus leaving the platform's crane as the only means for transporting the personnel.

The system is known (U.S. Pat. No. 4,003,473) which uses a ramp (gangway) as a mooring element, thus providing stable connection for personnel between supply boat and platform. This system did not find wide use because it is permanently located on the relatively low height from water level and therefore is subject for destruction during severe storms.

In both mentioned systems the supply boat uses its bow anchor for orientation and tensioning mooring lines. In the cases when the offshore platform is locaed in deep water, the anchor can not be used. In these cases the supply boat uses its engine and propeller to create a trust sufficient to tension the mooring lines.

SUMMARY OF THE INVENTION

It is the principal object of this invention to provide a berth which will permit the supply boat to be quickly and safely moored, even during severe weather conditions, to the offshore platform without employing its anchor and which will have permanent means for safely transporting personnel between platform and supply boat. At the same time this berth will have ability to survive any severe storm.

The berth of this invention has two positions: working and stored. At the working position the berth is located near the water and part of it is submerged, serving as a fendering system. At the stored position the entire berth is lifted to the upper level of the offshore platform, thus excluding it from being affected by any waves.

The berth consists of a floating fendering system with massive intermediate platform and system for lifting it to the upper deck of the offshore platform. The lifting system, when the berth is in working position, serves as a part of the berth's suspension system. Due to the suspension system the breasting dolphin has an ability to transfer the kinetic energy of the berthing supply boat into potential energy of deflected pendulum, which is formed by the massive intermediate platform and lines on which it is suspended.

The elements of the lifting system such as a boom of the derrick crane and one of the suspension lines are used as a structure for the ladders with fixed steps and handrails, forming comfortable and safe way for personnel from the upper deck of the offshore platform to the intermediate platform of the breasting dolphin.

The passenger elevator is used to lift the personnel from the intermediate platform to the upper deck.

The two mooring lines, which are permanently connected to the ends of the breasting dolphin through special pneumatic mooring winches, are in easy access to the operators of the supply boat, thus simplifying the mooring operation.

BRIEF DESCRIPTION OF THE DRAWINGS

For the full understanding of the invention, reference should be had to the following detailed description taken in connection with the accompanying drawing, in which.

DETAILED DESCRIPTION

Figure 1:
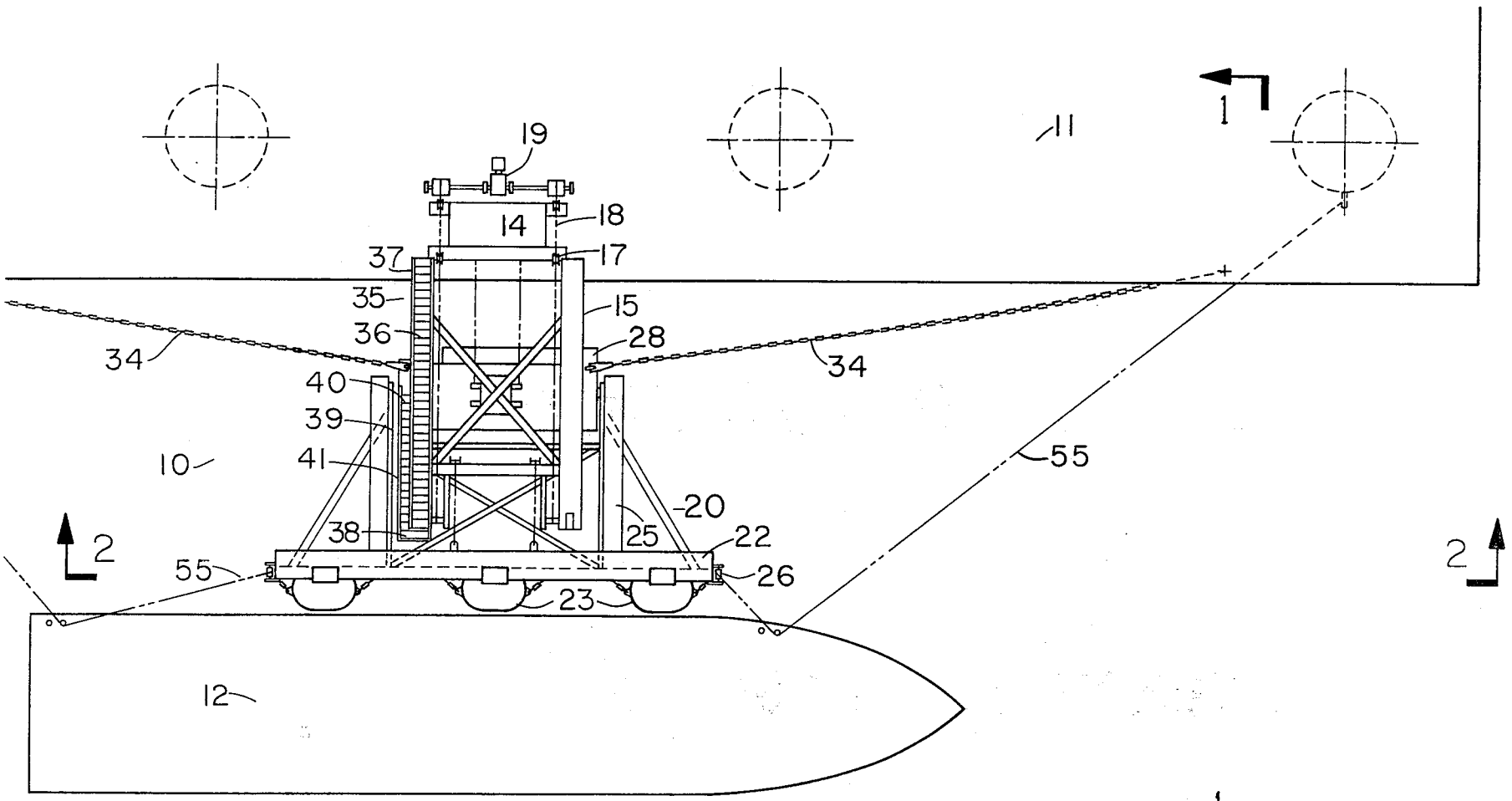
FIG. 1 is a plan view of the berth in working position and partial view of the offshore platform.
Figure 2:
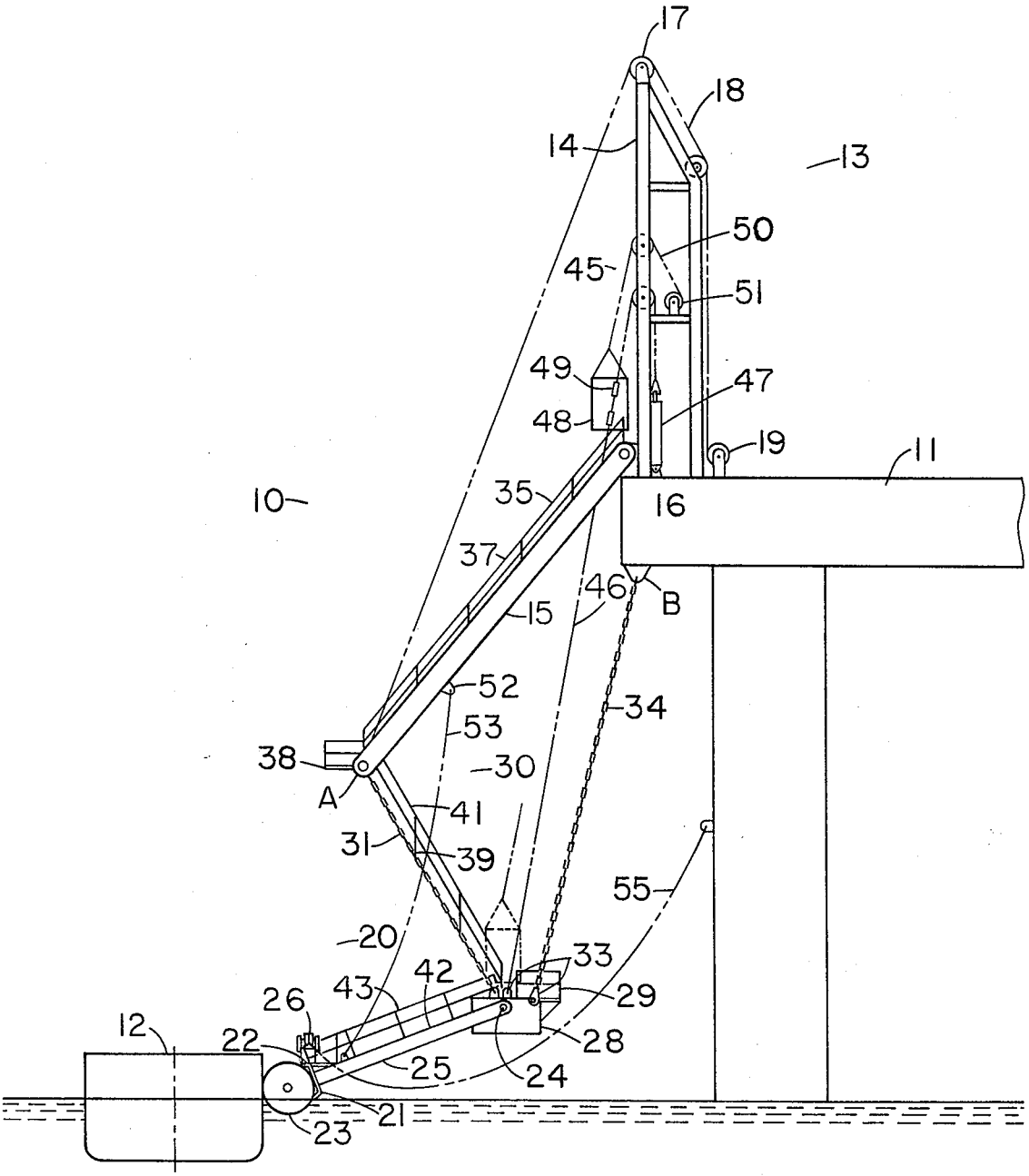
FIG. 2 is a sectional view of the berth in working position in direction 1—1 in FIG. 1.
Figure 3:
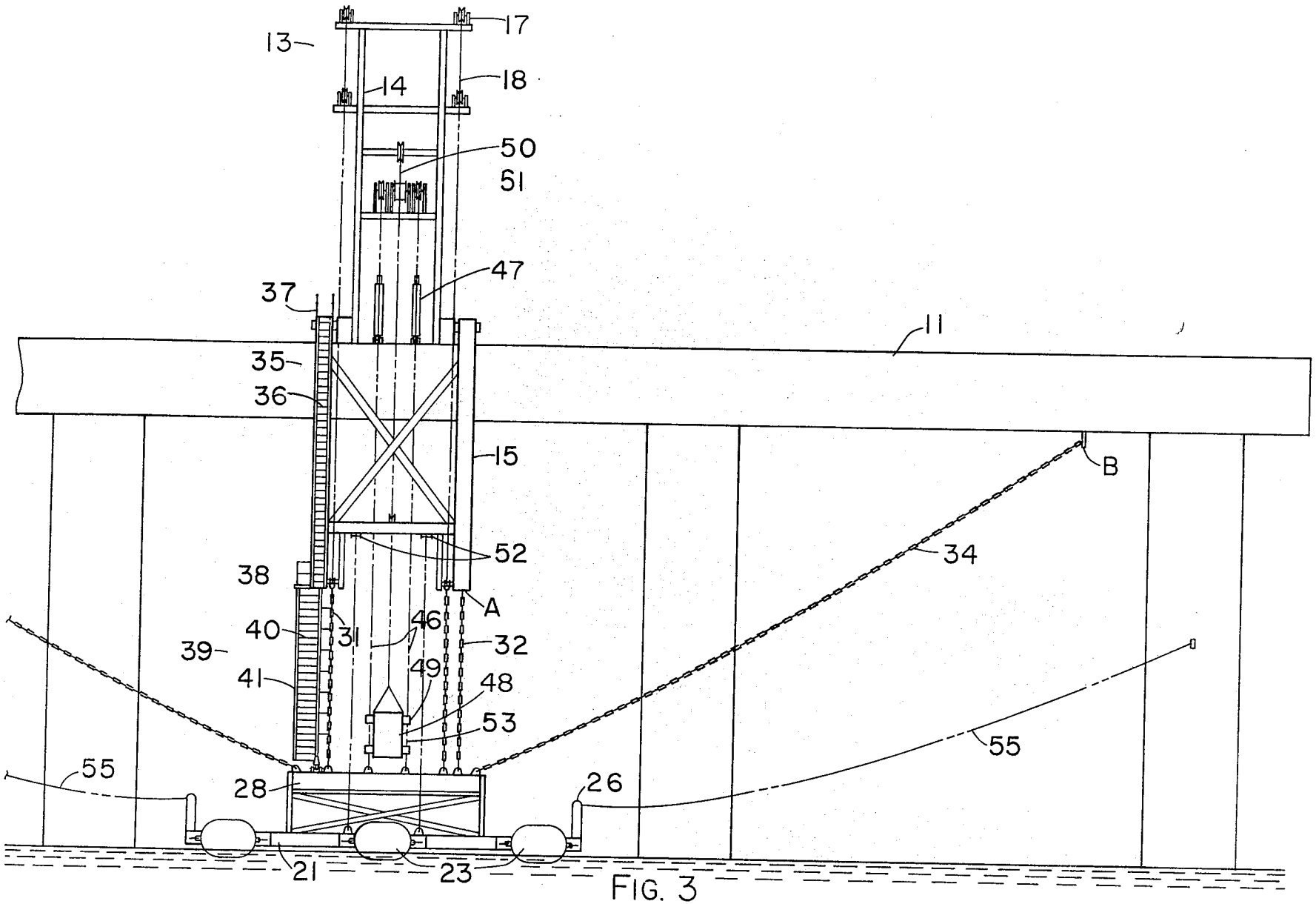
FIG. 3 is an elevation of the berth in working position in direction 2—2 in FIG. 1.
Figure 4:
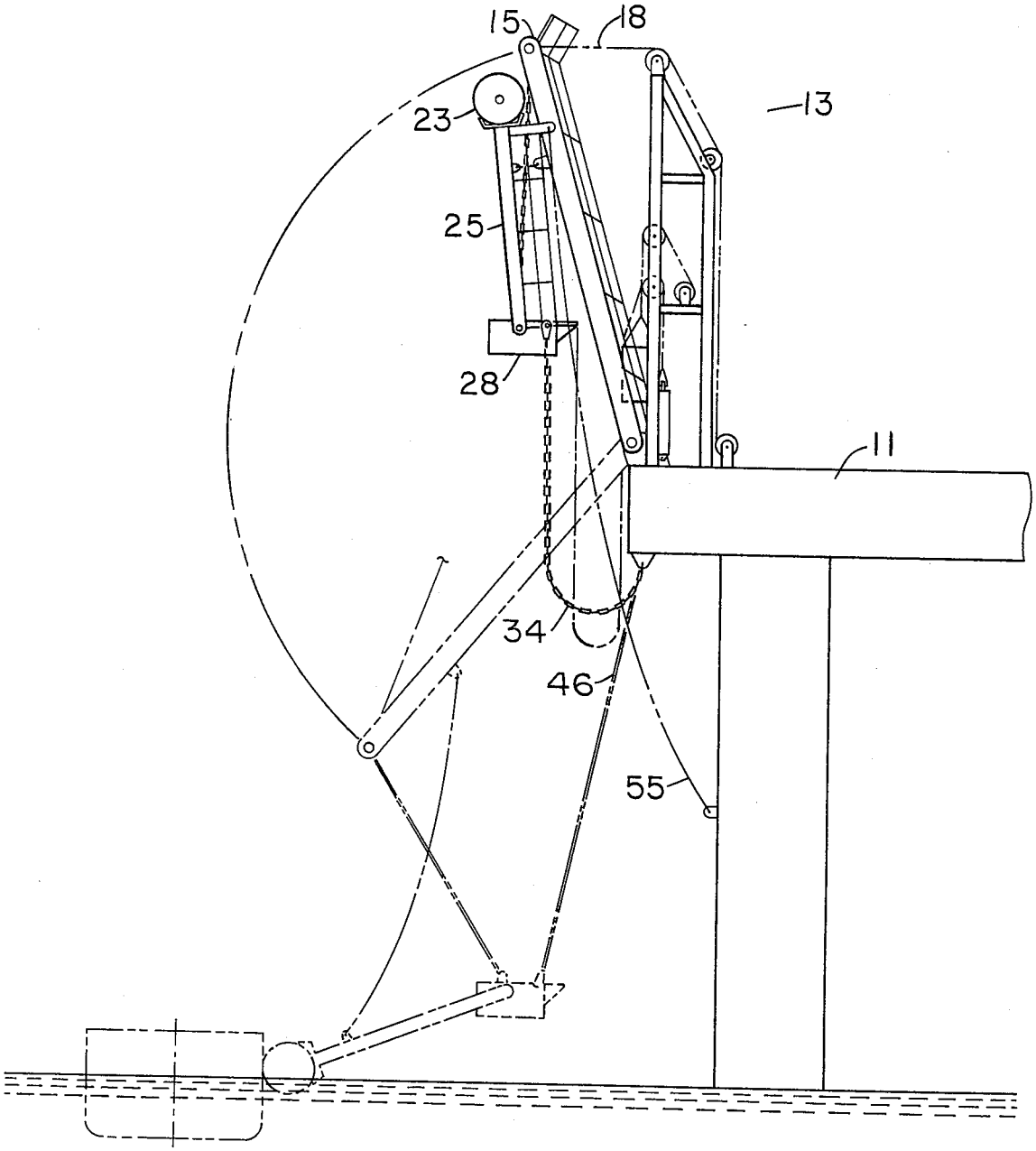
FIG. 4 is a sectional view of the berth in stored position in direction 1—1 in FIG. 1.
Figure 5:
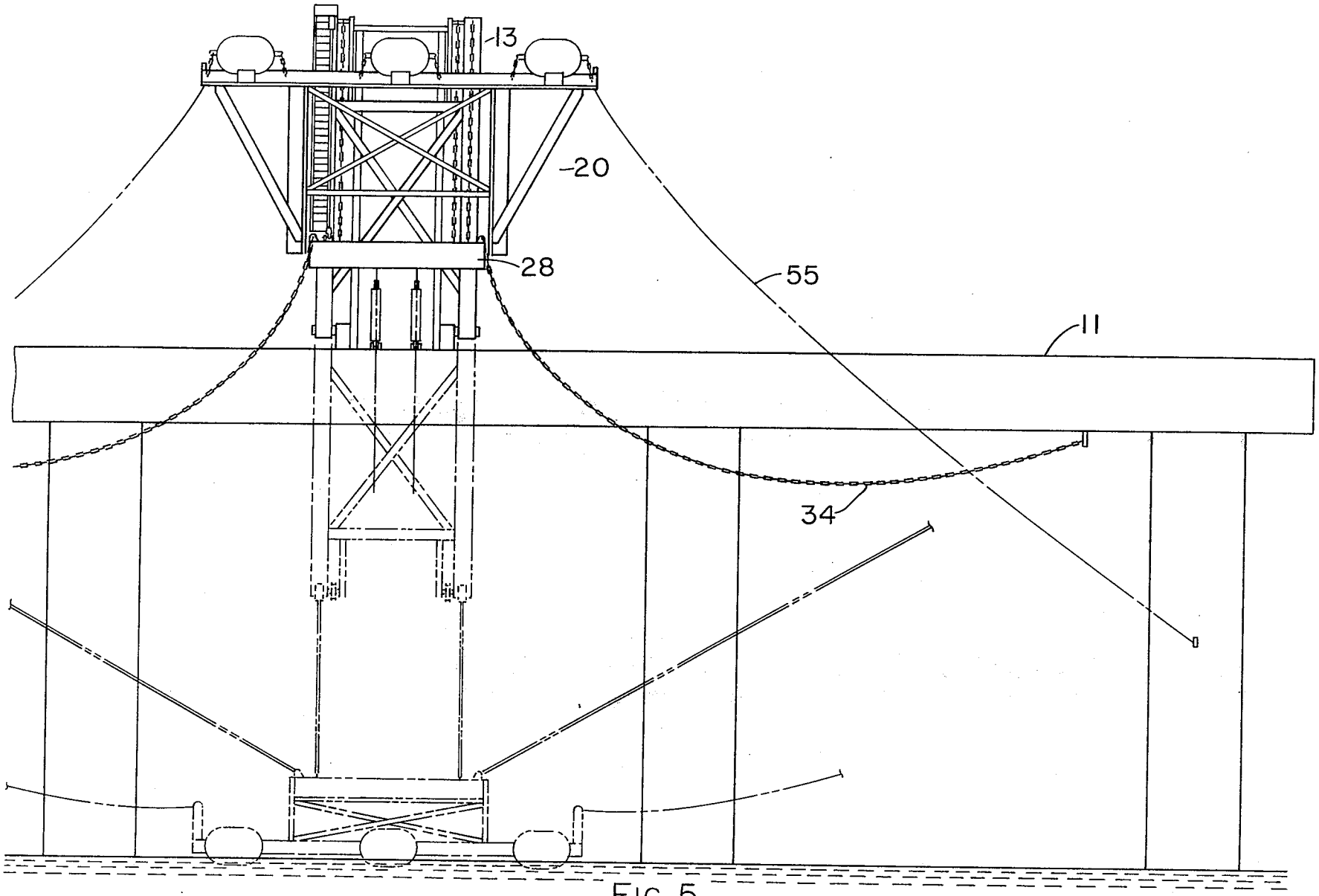
FIG. 5 is an elevation of the berth in stored position in direction 2—2 in FIG. 2.

Referring to the drawings FIG. 1 and FIG. 2 a berth 10 for offshore platform 11 with supply boat 12 is shown.

The offshore platform 11 can be of floating or fixed design. The berth 10 is arranged from several systems able to accomodate impact from a berthing supply boat, to transfer the personnel from the offshore platform to the supply ship and backwards, to lift the fendering system from the water to the level of the offshore platform's upper deck.

The berth 10 consists of:

A derrick crane 13, having a tower 14, formed of welded steel structures and mounted to the upper deck of the offshore platform, a boom 15, connected by one end to the base of the tower through a pivotal pin 16 and by other end to the top of the tower through sheaves 17, luffing ropes 18 and luffing winch 19. A floating fendering system 20, having a breasting beam 21, formed of an elongated welded steel structure, with its upper part used as a walking deck 22 and with pneumatic fenders 23 attached to the front part of the breasting beam. The buoyancy of the submerged part of the fenders 23 will keep the breasting beam 21 floating and pivoting around the axis of trunions 24 to which it is engaged through two levers 25, rigidly connected to the beam 21. On the edges of the beam 21 are located two pneumatically operated mooring rope reels 26.

An intermediate massive platform 28, having a form of a rectangular box, welded from steel plates and filled with concrete as a ballast is provided.

The upper part of the platform 28 is used as a walking deck and includes handrails 29. On the shortest sides of the platform 28 are located two trunions 24, to which levers 25 are engaged. A berth suspension system 30, includes two outer flexible lines 31 and 32 in the form of anchor chains connecting the platform 28 to the top of boom 15 through the pad eyes 33, located on the center line of the platform 28, two inner flexible lines 34, also in the form of anchor chains, connecting the platform 28 to the upper deck of offshore platform 11 through the pad eye 33, located on the inner edge of the platform 28. This suspension system forms a gravity balanced pendulum with two pivotal points separated by a considerable distance. Due to the preinclined position of suspension lines 31 and 34, each serving as a lever of the pendulum, any horizontal movement of the platform 28 will lead to substantial lifting the C.G. of the platform 28, thus transfersing the kinetic energy into the potential energy of a pendulum.

A personnel link between the upper deck of offshore platform 11 and the berthed supply boat 12 is formed from a permanent ladder 35, having its steps 36, handrails 37 and gangway board 38 incorporated on the one of the sides of the boom 15, a flexible ladder 39, having its steps 40 and handrails 41 incorporated with anchor chain line 31, a gangway 42 with handrails 43 incorporated on each lever 25.

An inclined vertical passenger elevator 45, having two guiding rails 46 in the form of flexible ropes with hydraulic tensioning cylinders 47, a cabin 48 with guiding shoes 49, inclined accordingly to the inclination of the guiding rails 46, a hoisting rope 50 and hoisting winch 51.

A winch 52, for lifting floating fendering system 20, located on the upper part of a boom 15 and having its hoisting ropes 53 connected to the levers 25, of the floating fendering system 20. A mooring line 55, connected permanently by one end to the points located on maximum distance apart, on the supporting structure of the offshore platform and by other end winded-up on the pneumatically actuated and remotely controlled mooring rope reel.

DESCRIPTION OF OPERATION

A. Berth in working position.

Supply boat 12 with certain speed and corresponded kinetic energy, approaches the berth under some angle and therefore first contacts one of the corners of the floating fendering system. Through one of the pneumatic fenders 23, breasting beam 21 and inclined levers 25, the supply boat will transfer its horizontal movement to the intermediate massive platform 28. Due to the angle of contact of the supply boat, the intermediate platform 28 will experience main movement perpendicular to the berthing line and partially along the berth.

Perpendicular horizontal movement of the platform 28, due to the lines 31 and 32, generates its rotation around the pivot point A, thus lifting C.G. of platform 28. The horizontal movement of platform 28 along the berth is restricted by one of the lines 34, which will generate rotation of one of the platform 28 ends around the pivot point 8, thus also lifting its C.G. on a certain height. During the period of transferring supply boat's movement to platform 28, the supply boat loses its kinetic energy and finally stops parallel to the berth. Accumulated potential energy in the height of the platform 28 will move the breasting beam 21 and supply boat back to its initial position.

After boat 12 is berthed, the crewmen on the boat will pick up the mooring line 55, conveniently located at an accessible distance from the boat's 12 board, and will pull it from the mooring rope reel 26 to the length sufficient to use boat's mooring arrangements.

B. Transfering the berth from working position into stored position.

Lifting the berth from the water starts by lifting the floating fendering system 20 by winch 52, located on the boom 15. Second step is lifting the boom 15 by luffing winch 19 until boom will come to the stop. During boom's luffing the mooring rope reel 26 is paying out the rope under tension, thus preventing it from being very loose. Final step of this invention is fixing the floating fendering system 20 in its upper position by tensioning winch 52.

Obviously, many modifications and variations of the present invention are possible in the light of the above teachings, and it is therefore understood that within the scope of the disclosed inventive concept, the invention may be practiced otherwise than specifically described.

What I claim as my invention is:

1. A berth for mooring ship to an offshore platform and transferring the personnel between them comprising a floating fendering system, having a breasting beam with positive buoyancy located along one of the sides of said offshore platform, a derrick crane located on an upper deck edge of said offshore platform and having a boom, tower and luffing winch, an intermediate massive platform, a pair of inclined levers through which said floating fendering system is connected to said intermediate massive platform, a berth suspension system having two pairs of suspension flexible lines, each pair of said suspension lines is connected through their lowest ends to said massive platform, forming a gravity balanced pendulum with two pivotal points, an outer pair of said lines is connected by its upper ends to said boom, of said derrick crane, the inner pair of said lines is connected to an upper deck of said offshore platform, a winch, for lifting said floating fendering system, located on the upper part of said boom and having hoisting ropes connected to said inclined levers, an elevator for transporting personnel from said intermediate platform to the upper deck of said offshore platform, a system of ladders and gangways, providing a pass for personnel between the upper deck of the offshore platform and a moored supply ship, a system supporting mooring operation.

2. A berth as defined in claim 1, wherein positive buoyancy of said breasting beam is formed by pneumatic fenders.

3. A berth as defined in claim 1, wherein said intermediate massive platform has a form of a rectangular box, comprising a ballast weight, placed inside said box, a deck with handrails on the top of said box, a pair of trunions located on the short sides of said box, to which said floating fendering system is connected through said inclined levers, a pair of pad eyes for said outer lines, located on the center line of said deck.

4. A berth according to claim 1, wherein said suspension flexible lines of said suspension system are formed of an anchor chains.

5. A berth as defined in claim 1, wherein an elevator for transporting personnel consists of a cabin with guiding shoes, a pair of guiding ropes with tensioning device and of a hoisting winch.

6. A berth as defined in claim 1, wherein a system of ladders and gangways providing pass for personnel between the upper deck of the offshore platform and moored supply ship consists of an upper ladder with fixed positioned stairs and handrails incorporated with said derrick's boom, a lower ladder with fixed positioned stairs and handrails connected to one of said suspension lines connecting said boom with said intermediate massive platform.

a gangway with fixed handrails incorporated with said inclined levers connecting said intermediate massive platform with said breasting beam.

7. A berth as defined in claim 1, wherein said system supporting mooring operation consists of two mooring ropes connected permanently by one end to supporting structure on said offshore platform and by the other end is winded up on a remote controlled powered mooring ropes reel located on said breasting beam.

* * * * *